US011312589B2

(12) United States Patent
Egawa

(10) Patent No.: US 11,312,589 B2
(45) Date of Patent: Apr. 26, 2022

(54) SHEET CONVEYING DEVICE AND IMAGE FORMING APPARATUS INCORPORATING THE SHEET CONVEYING DEVICE

(71) Applicant: Tomohiro Egawa, Kanagawa (JP)

(72) Inventor: Tomohiro Egawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 16/688,607

(22) Filed: Nov. 19, 2019

(65) Prior Publication Data

US 2020/0156889 A1 May 21, 2020

(30) Foreign Application Priority Data

Nov. 21, 2018 (JP) ..... JP2018-217901
Oct. 28, 2019 (JP) ..... JP2019-195339

(51) Int. Cl.
*B65H 29/00* (2006.01)
*B65H 5/12* (2006.01)
*B65H 7/06* (2006.01)

(52) U.S. Cl.
CPC ..... *B65H 5/12* (2013.01); *B65H 7/06* (2013.01); *B65H 29/003* (2013.01)

(58) Field of Classification Search
CPC ..... B65H 5/12; B65H 7/06; B65H 29/003; B65H 5/14; B65H 29/005; B65H 29/06; B65H 29/047; B65H 29/045; B65H 29/04
See application file for complete search history.

(56) References Cited

U.S. PATENT DOCUMENTS 3,536,321 A * 10/1970 Straube ..... B41F 21/10 271/277
4,372,209 A * 2/1983 Jentzsch ..... B41F 21/104 101/409
4,390,176 A * 6/1983 Kato ..... B65H 5/12 101/411
4,759,290 A * 7/1988 Holl ..... B41F 21/10 101/415.1
4,815,870 A * 3/1989 Sparer ..... B41J 13/223 101/409
5,396,842 A * 3/1995 Quinci ..... B41F 21/102 101/409
7,165,492 B2 * 1/2007 Koberg ..... B41F 27/1212 101/409

(Continued)

FOREIGN PATENT DOCUMENTS

JP 5-188795 7/1993
JP 10-181986 7/1998

(Continued)

*Primary Examiner* — Thomas A Morrison
(74) *Attorney, Agent, or Firm* — Duft & Bornsen, PC

(57) ABSTRACT

A sheet conveying device includes a sheet conveyor, a guide, a rotary conveyor, a gripper, and an adjuster. The sheet conveyor is configured to convey a sheet. The guide is configured to guide the sheet conveyed by the sheet conveyor. The rotary conveyor is disposed downstream from the guide in a sheet conveyance direction. The gripper is mounted on the rotary conveyor, the gripper configured to grip a leading end of the sheet. The adjuster is configured to adjust a sheet entering range of the gripper to which the leading end of the sheet enters, along with conveyance of the sheet conveyor, in a direction intersecting a sheet surface.

5 Claims, 6 Drawing Sheets

(56) References Cited

U.S. PATENT DOCUMENTS

| | | | | |
|---|---|---|---|---|
| 7,837,189 | B2 * | 11/2010 | Young | B65H 31/34 271/187 |
| 8,100,054 | B2 * | 1/2012 | Koberg | B41C 1/1083 101/415.1 |
| 8,725,046 | B2 * | 5/2014 | Okamoto | G03G 15/1665 399/304 |
| 2019/0161299 | A1 | 5/2019 | Egawa et al. | |
| 2019/0161301 | A1 | 5/2019 | Maeyama et al. | |
| 2019/0241385 | A1 | 8/2019 | Kaneko et al. | |
| 2019/0276258 | A1 | 9/2019 | Egawa et al. | |
| 2019/0283998 | A1 | 9/2019 | Uchida et al. | |

FOREIGN PATENT DOCUMENTS

| | | |
|---|---|---|
| JP | 2001-106374 | 4/2001 |
| JP | 2009-292590 | 12/2009 |
| JP | 2012-039207 | 2/2012 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2018-217901, filed on Nov. 21, 2018, and 2019-195339, filed on Oct. 28, 2019, in the Japan Patent Office, the entire disclosure of each of which is hereby incorporated by reference herein.

BACKGROUND

Technical Field

This disclosure relates to a sheet conveying device and an image forming apparatus incorporating the sheet conveying device.

Related Art

Various types of sheet conveying devices are known to include a sheet gripping member such as a gripper mounted on a rotary sheet conveyor such as a cylinder and a drum. While the sheet gripping member grips a sheet, the rotary sheet conveyor is rotated to convey the sheet to a target portion.

SUMMARY

At least one aspect of this disclosure provides a sheet conveying device including a sheet conveyor, a guide, a rotary conveyor, a gripper, and an adjuster. The sheet conveyor is configured to convey a sheet. The guide is configured to guide the sheet conveyed by the sheet conveyor. The rotary conveyor is disposed downstream from the guide in a sheet conveyance direction. The gripper is mounted on the rotary conveyor, the gripper configured to grip a leading end of the sheet. The adjuster is configured to adjust a sheet entering range of the gripper to which the leading end of the sheet enters, along with conveyance of the sheet conveyor, in a direction intersecting a sheet surface.

Further, at least one aspect of this disclosure provides an image forming apparatus including the above-described sheet conveying device and an image forming device configured to form an image on the sheet conveyed by the sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
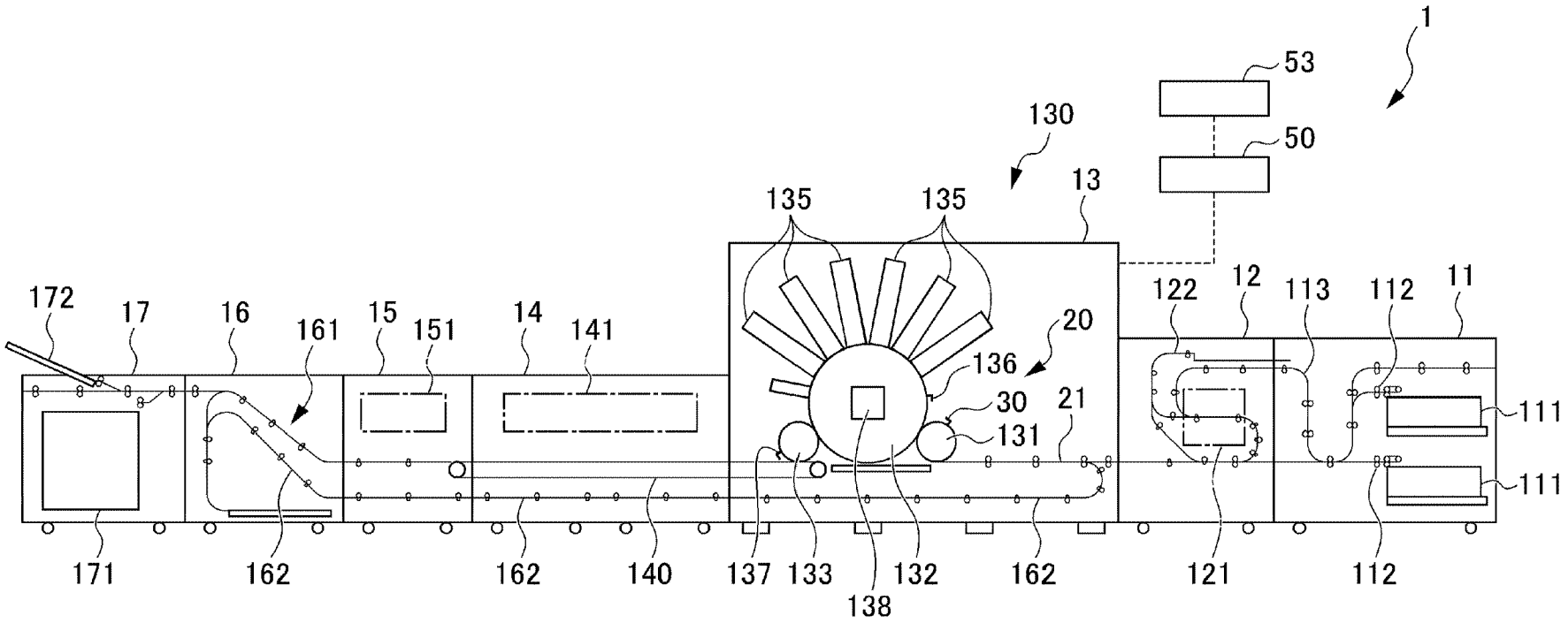
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet conveying device and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet conveying device, and is implemented in the most effective manner in any inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a sheet conveying device and an image forming apparatus incorporating the sheet conveying device, with reference to the following figures.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus 1 according to an embodiment of this disclosure.

A description is given of an overall configuration of the image forming apparatus 1, with reference to FIG. 1.

The image forming apparatus 1 includes a sheet feeding device 11, a pre-coating device 12, an image forming device 13, a drying device 14, a cooling device 15, a reversing device 16, a sheet ejection device 17, a control device 50, and an operation device 53.

The sheet feeding device 11 includes sheet trays 111, sheet feeding units 112, and a sheet conveying unit 113.

A plurality of sheets P loaded on each of the sheet trays 111 are separated one by one by a corresponding one of the sheet feeding units 112. Then, each separated sheet P is conveyed to the pre-coating device 12 by the sheet conveying unit 113.

The pre-coating device 12 includes a pre-coating unit 121 and a pre-coating conveyance unit 122. The pre-coating unit 121 performs pre-processing to the sheet P. The pre-coating conveyance unit 122 conveys the sheet P. The pre-coating unit 121 applies processing liquid to a sheet P prior to conveyance to the image forming device 13. The processing liquid is, for example, a chemical agent that reacts with ink to reduce bleeding of the ink to a sheet.

The image forming device 13 includes a sheet conveying device 20 and an ink discharging device 130. The sheet conveying device 20 conveys a sheet P to which a pre-processing has been performed. The ink discharging device 130 discharges ink to the sheet P to be conveyed by the sheet conveying device 20 to form an image on the sheet P.

The ink discharging device 130 discharges a plurality of colors of inks to form an image on the sheet P. The ink discharging device 130 includes a plurality of liquid discharging heads 135 that correspond to respective colors of inks. Further, the term "liquid discharging head", which corresponds to the plurality of liquid discharging heads 135 in the present embodiment, indicates a functional component that discharges and sprays liquid from liquid discharging holes (nozzles). The ink of each of the plurality of liquid discharging heads 135 discharges liquid of each color of cyan (C), magenta (M), yellow (Y), and black (K). The plurality of liquid discharging heads 135 may include, for example, a liquid discharging head to discharge special ink, such as white, gold, and silver. The plurality of liquid discharging heads 135 may further include a liquid discharging head to discharge a liquid that does not constitute an image, such as a surface coating liquid, as needed.

Respective discharging operations of the plurality of liquid discharging heads 135 are individually controlled by respective drive signals according to image data.

It is to be noted that the term "image" to be formed on a sheet P (i.e., the sheet P) is not limited to visible significant images such as texts and figures. In other words, the term "image" includes, for example, patterns that themselves have no meaning.

The sheet conveying device 20 includes a roller conveyance unit 21, a transfer cylinder 131, a drum 132, and a transfer cylinder 133, aligned in this order to receive and convey the sheet P in a sheet conveyance direction of the image forming apparatus 1. Each of the transfer cylinder 131, the drum 132, and the transfer cylinder 133 functions as a rotary conveyor. The transfer cylinder 131, the drum 132, and the transfer cylinder 133 extend along respective axial directions in a long cylinder shape.

A gripper 30 is mounted on a circumferential surface of the transfer cylinder 131. The gripper 30 grips and holds the leading end of a sheet P. The gripper 30 is a sheet gripping member to grip and hold the leading end of the sheet P.

Figure 2:
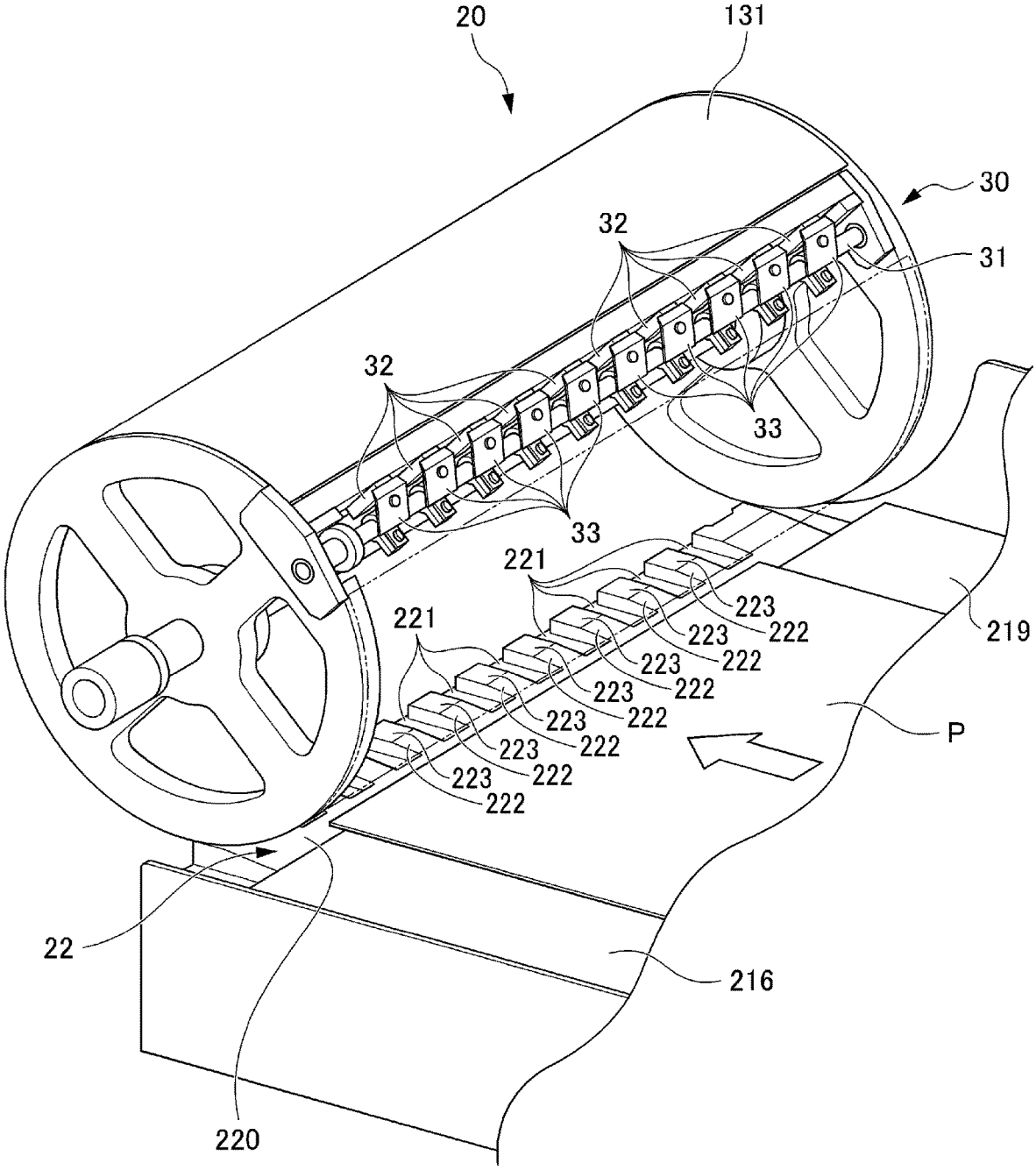
FIG. 2 is a perspective view illustrating a transfer cylinder and a gripper of a sheet conveying device according to Embodiment 1 of this disclosure.

FIG. 2 is a perspective view illustrating the transfer cylinder 131 and the gripper 30 of the sheet conveying device 20 according to Embodiment 1 of this disclosure.

In FIG. 2, part of the transfer cylinder 131 is omitted so that part of an adjustment mechanism 22 of the sheet conveying device 20 can be seen.

As illustrated in FIG. 2, the gripper 30 includes a gripper rotary shaft 31, claw bases 32, and claws 33. A plurality of claws 33 are arranged in an interdigital shape on the gripper rotary shaft 31, so that the plurality of claws 33 are rotated simultaneously along with rotation of the gripper rotary shaft 31. A plurality of claw bases 32 are arranged on the transfer cylinder 131, corresponding to the number of the plurality of claws 33, so that the plurality of claw bases 32 and the plurality of claws 33 sandwich the sheet P.

The plurality of claws 33 are opened and closed by a mechanical device.

A cam mechanism is disposed at each of the end of the gripper rotary shaft 31 and a housing of the sheet conveying device 20. As the cam mechanism rotates the transfer cylinder 131, the gripper 30 reaches a position at which the gripper 30 holds and grips the sheet P. Accordingly, the gripper rotary shaft 31 rotates to cause the plurality of claws 33 to approach the plurality of claw bases 32. It is to be noted that the configuration to rotate the gripper rotary shaft 31 is not limited to a mechanical device. For example, a configuration to rotate the gripper rotary shaft 31 at a given timing by a motor may be applied to this disclosure.

The sheet P conveyed to the image forming device 13 is moved to a transfer position with the drum 132 while the sheet P is wound around the circumferential surface of the transfer cylinder 131 with the leading end of the sheet P being held by the gripper 30. It is to be noted that the details of a transfer operation of the transfer cylinder 131 for transferring the sheet P from the roller conveyance unit 21 to the gripper 30 of the transfer cylinder 131 will be described below.

A gripper 136 that is similar to the gripper 30 of the transfer cylinder 131 is mounted on the circumferential surface of the drum 132. A gripper 137 that is also similar to the gripper 30 of the transfer cylinder 131 is mounted on the circumferential surface of the transfer cylinder 133. The gripper 136 of the drum 132 has a plurality of claws that are arranged in an interdigital shape to be alternating with the plurality of claws 33 of the gripper 30 of the transfer cylinder 131. The sheet P is transferred at positions where the gripper 136 and the gripper 30 face each other. Similarly, the gripper 137 of the transfer cylinder 133 has a plurality of claws that are arranged in an interdigital shape to be alternating with the plurality of claws of the gripper 136 of the drum 132. The sheet P is transferred at positions where the gripper 137 and the gripper 136 face each other.

An air suction unit 138 is disposed inside the drum 132. A plurality of suction holes is dispersedly formed in the surface of the drum 132. When the air suction unit 138 is activated, air suction flow that sucks the sheet P is generated. After the sheet P has been transferred from the transfer cylinder 131 to the drum 132, the gripper 136 grips the leading end of the sheet P, and simultaneously the sheet P is conveyed along with rotation of the drum 132 while the sheet P is attracted to the surface of the drum 132 by suction airflow.

When the sheet P that is carried by the drum 132 passes an opposing region facing the ink discharging device 130, respective inks are discharged from the liquid discharging heads 135, so that an image is formed according to image data. The sheet P on which the image is formed is conveyed from the drum 132 to the transfer cylinder 133. The sheet P that is conveyed to the transfer cylinder 133 is further conveyed to a belt conveyor 140 that leads to the drying device 14. An air suction unit is disposed on the belt conveyor 140, so that the sheet P is conveyed through the drying device 14 while being sucked by the air suction unit.

The drying device 14 includes a dryer 141 to dry the sheet P that is conveyed by the belt conveyor 140. As the dryer 141 causes liquid such as moisture in the inks to evaporate, so that the ink is fixed on the sheet P. The sheet P that has been dried by the dryer 141 is conveyed to the cooling device 15 by the belt conveyor 140.

The cooling device 15 includes a cooler 151 to cool the sheet P that has been dried by the dryer 141. The sheet P that has been cooled in the cooler 151 is conveyed to the reversing device 16.

The reversing device 16 includes a reversing unit 161 to switch sheet conveyance passages depending on whether a single-side printing or a duplex printing is performed. When the single-side printing is set, the reversing unit 161 conveys the sheet P to the sheet ejection device 17 without reversing the sheet P. When the duplex printing is set, the reversing unit 161 reverses the sheet P and conveys the sheet P to a sheet reverse passage 162. The sheet reverse passage 162 connects the image forming device 13, the drying device 14, the cooling device 15, and the reversing device 16. The sheet P conveyed to the sheet reverse passage 162 is reversed and conveyed to the transfer cylinder 131 with the sheet P being reversed. After being conveyed to the transfer cylinder 131, an image is formed on the back face side of the sheet P through image formation that is same as the image formation performed to the front face side of the sheet P.

The sheet ejection device 17 includes a sheet ejection cassette 171 and a sheet ejection tray 172. The sheet ejection cassette 171 contains the sheet P that has passed the reversing device 16. The sheet ejection tray 172 ejects the sheet P to an outside of the image forming apparatus 1. The sheet P conveyed to the sheet ejection device 17 is to be conveyed to the sheet ejection cassette 171 or the sheet ejection tray 172.

The control device 50 is a computer that performs various controls of the sheet conveying device 20 and the image forming apparatus 1. It is to be noted that the physical location of the control device 50 is not particularly limited. That is, the control device 50 may be disposed at a predetermined position of the image forming apparatus 1 or the control device 50 may perform control the image forming apparatus 1 remotely via communication.

The operation device 53 includes a touch panel display and operation buttons. The operation device 53 may be disposed in the image forming apparatus 1 or may be an external computer. The operation device 53 is electrically connected to the control device 50. Through the operation device 53, instructions are issued to start a print job and the type of a target sheet P onto which an image is formed is set.

The overall configuration of the image forming apparatus 1 has been described above. However, the configuration of the image forming apparatus 1 is not limited to the above-described configuration but may be modified appropriately. For example, other functional units may be added as appropriately. To be more specific, for example, a post-processing device may be added to perform a process of binding a plurality of sheets P in the sheet ejection device 17. Moreover, part of the configuration such as the pre-coating device 12, the drying device 14, the cooling device 15, and the reversing device 16 may be omitted.

Next, a description is given of the sheet conveying device 20 that is disposed in the image forming device 13.

Figure 3:
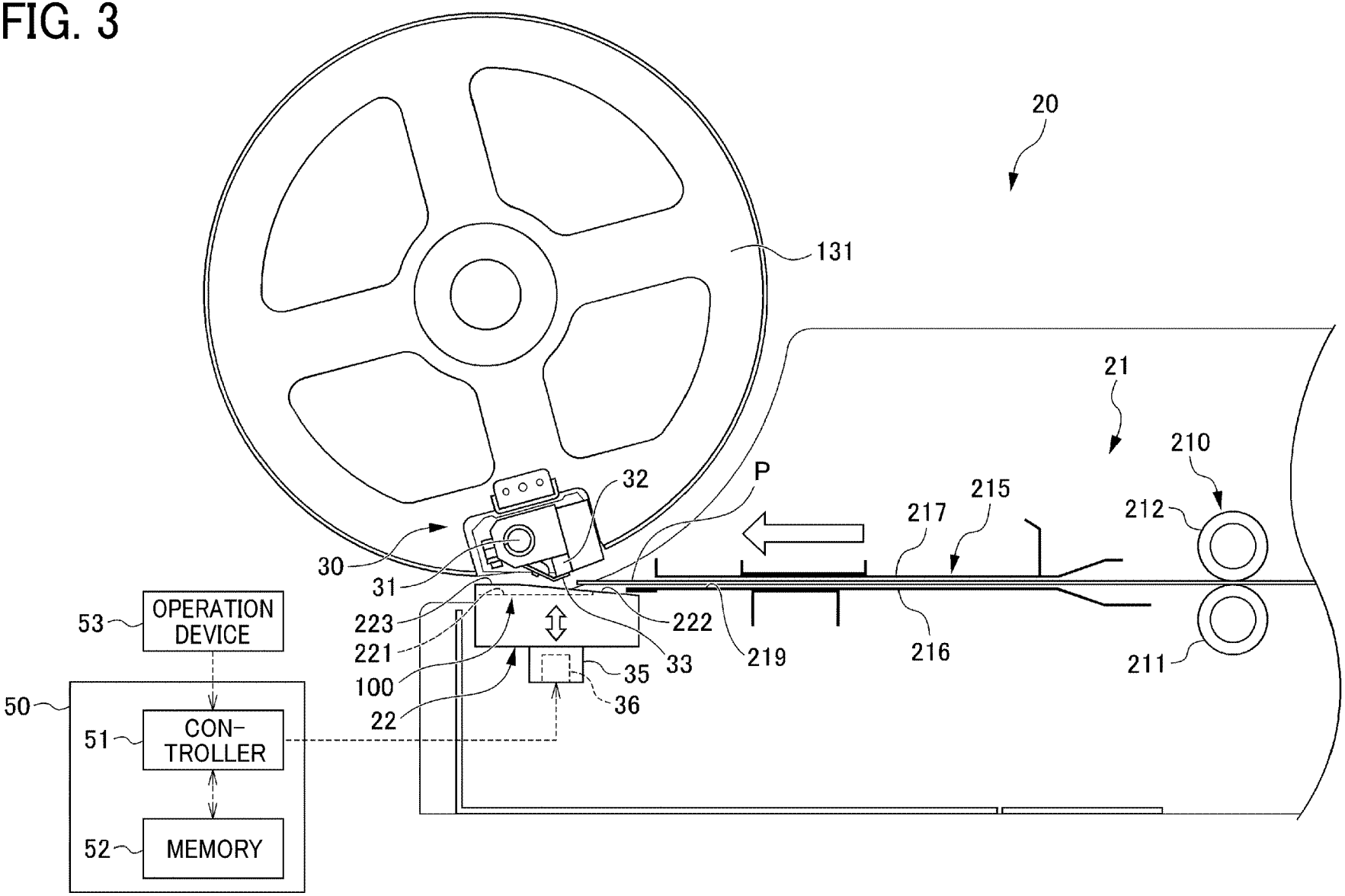
FIG. 3 is a diagram illustrating a configuration of the sheet conveying device according to Embodiment 1.

FIG. 3 is a diagram illustrating a configuration of the sheet conveying device 20 according to Embodiment 1.

As illustrated in FIG. 3, the sheet conveying device 20 according to Embodiment 1 has a configuration to convey the sheet P to the above-described transfer cylinder 131 and includes a roller conveyance unit 21, a fixed guide 215, and an adjustment mechanism 22.

The roller conveyance unit 21 is a pair of rollers 210 including two rollers 211 and 212 disposed facing each other. Of the two rollers 211 and 212 of the pair of rollers 210, one is a drive roller and the other is a driven roller that is pressed against the drive roller. As the rollers 211 and 212 of the pair of rollers 210 of the roller conveyance unit 21 rotate, the sheet P is conveyed toward a downstream side in a sheet conveyance direction.

The fixed guide 215 includes a lower guide portion 216 and an upper guide portion 217 that are disposed spaced apart. The sheet P that is conveyed by the roller conveyance unit 21 is conveyed toward the downstream side in the sheet conveyance direction, along a sheet conveying surface 219 of the lower guide portion 216. The sheet conveying surface 219 of the lower guide portion 216 of Embodiment 1 is a face extending along a horizontal direction. The sheet P passes through a gap between the lower guide portion 216 and the upper guide portion 217 of the fixed guide 215, and is conveyed to a transfer position 100 at which the sheet P is transferred to the gripper 30 of the transfer cylinder 131. It is to be noted that the sheet conveying surface 219 is a virtual face that is formed along the sheet conveyance direction of the sheet P to be conveyed by the lower guide portion 216 and is conveyed in layers with a sheet surface 200, and therefore the configuration of the sheet conveying surface 219 is not limited to a partial or whole area on the upper face of the lower guide portion 216.

The adjustment mechanism 22 that functions as an adjuster is disposed at the transfer position 100, which is disposed downstream from the fixed guide 215 in the sheet conveyance direction. The adjustment mechanism 22 includes a movable guide 220 and a movable guide moving mechanism 35. The movable guide 220 is movable in a vertical direction of the adjustment mechanism 22. The movable guide moving mechanism 35 moves (lifts and lowers) the movable guide 220 in the vertical direction.

The movable guide 220 is a separate body from the fixed guide 215. The movable guide 220 is provided with a guide groove 221 that corresponds to a position of the claw 33 of the gripper 30. The sheet P is gripped while the claw 33 of the gripper 30 is in the guide groove 221. The shape of the guide groove 221 is illustrated in FIG. 2 as well. It is to be noted that the configuration of the gripper 30 in FIG. 2 is illustrated to have multiple claws 33 (the plurality of claws 33) and multiple guide grooves 221 corresponding to the multiple claws 33.

The movable guide moving mechanism 35 is a mechanical mechanism such as a gear and a slide member. The movable guide moving mechanism 35 according to the present embodiment includes a motor 36 that functions as a drive device to move the movable guide 220 in the vertical direction. The amount of movement of the movable guide 220 is determined based on a drive amount of the motor 36. The motor 36 is driven and controlled by a control signal transmitted from the control device 50.

Now, a description is given of the drive control of the motor 36 performed by the control device 50.

The control device 50 includes a controller 51 and a memory 52. The controller 51 executes various processes such as image formation and conveyance timing determination. The memory 52 stores various information such as image formation of an image to be formed on a sheet P and a type of the sheet P. The drive control of the motor 36 is performed based on thickness information indicating the thickness of a target sheet P on which an image is formed.

The thickness information of the sheet P may be a table set for each type of the sheet P or may be set by input by a user. The controller 51 determines the drive amount of the motor 36 based on the thickness information to be input via the operation device 53 and adjusts the height of the movable guide 220. It is to be noted that the adjustment mechanism 22 adjusts the height of a sheet P, which is a positional adjustment of the sheet P including the vertical direction to the sheet surface 200, as a component. That is, the adjustment mechanism 22 includes a configuration that adjusts the position of the leading end of the sheet P in a direction intersecting at least the sheet surface 200. Alternatively, the adjustment mechanism 22 may include a configuration that moves the position of the leading end of the sheet P in an oblique direction that is a direction extending obliquely to the sheet surface 200.

In a comparative sheet conveying device, while a sheet gripping member such as a gripper mounted on a rotary sheet conveyor such as a transfer drum grips the leading end of a recording medium such as a sheet, the transfer drum conveys the sheet to a photoconductor drum.

When a sheet is transferred to the sheet gripping member of the rotary sheet conveyor, it is likely that the sheet is brought to be gripped by the sheet gripping member while the sheet is misaligned or bent due to flapping or fluttering of the leading end of the sheet. The comparative sheet conveying device is required to include a function to convey sheets different in thickness. When conveying relatively thin sheets, however, space for play is large relative to intervals of the sheet gripping members, it is highly likely to cause the leading end of a sheet to flap. Therefore, the comparative sheet conveying device have room for improvement in terms of preventing or restraining a sheet from flapping.

Now, a description is given of movement of the movable guide 220.

Figure 4:
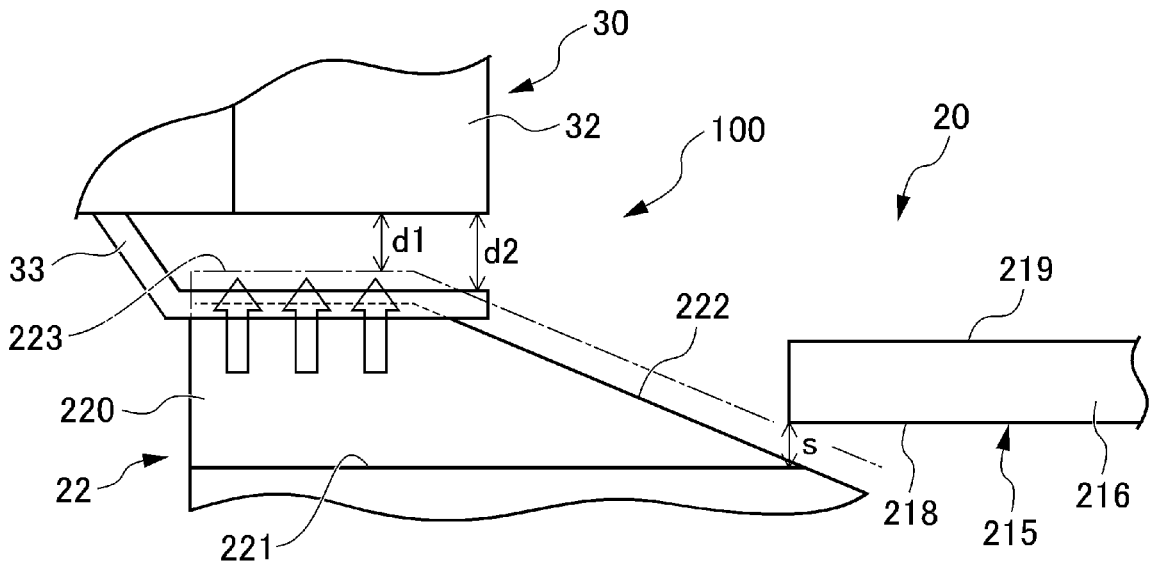
FIG. 4 is a diagram illustrating a state in which an adjusting position of an adjustment mechanism according to Embodiment 1 is set.

FIG. 4 is a diagram illustrating a state in which an adjusting position of the adjustment mechanism 22 according to Embodiment 1 is set.

As illustrated in FIG. 4, the movable guide 220 according to the present embodiment (Embodiment 1) has an upper face on an upstream side in the sheet conveyance direction to be sloped, that is, a sloped face 222, and an upper face on a downstream side in the sheet conveyance direction to be horizontal, that is, a horizontal face 223. The sloped face 222 is sloped (inclined) upwardly toward the downstream side in the sheet conveyance direction.

At a standby position before positional adjustment, the horizontal face 223 of the movable guide 220 is located lower than a gap (space) between the claw base 32 and the claw 33. This standby position is set in consideration of the movable range of the movable guide 220. A clearance s indicates margin for adjustment between the end on the downstream side of the lower face 218 of the lower guide portion 216 in the sheet conveyance direction and the sloped face 222 of the movable guide 220. The clearance s is set to a size in which the movable guide 220 and the lower guide portion 216 do not collide when the movable guide 220 is fully lifted to the maximum height (position).

The controller 51 drives the motor 36 at the drive amount based on the thickness information of the set sheet P and causes the movable guide 220 to move from the standby position to an adjusting position in the vertical direction. This vertical direction of the movable guide 220 also corresponds to a direction perpendicular to the sheet surface 200 while the sheet P is at a gripping position.

As described above, the movable guide 220 reaches the adjusting position indicated by a broken line while avoiding interference with the claw 33 by the guide groove 221 formed in the movable guide 220. At the adjusting position, an interval (distance) d1 between the horizontal face 223 of the movable guide 220 and the claw base 32 is smaller (narrower) than an interval (distance) d2 between the claw base 32 and the claw 33. According to this configuration, a vertical range between the claw base 32 and the claw 33 is narrowed for the sheet P to enter.

Next, a description is given of behavior of the sheet P at the transfer position 100.

Figure 5:
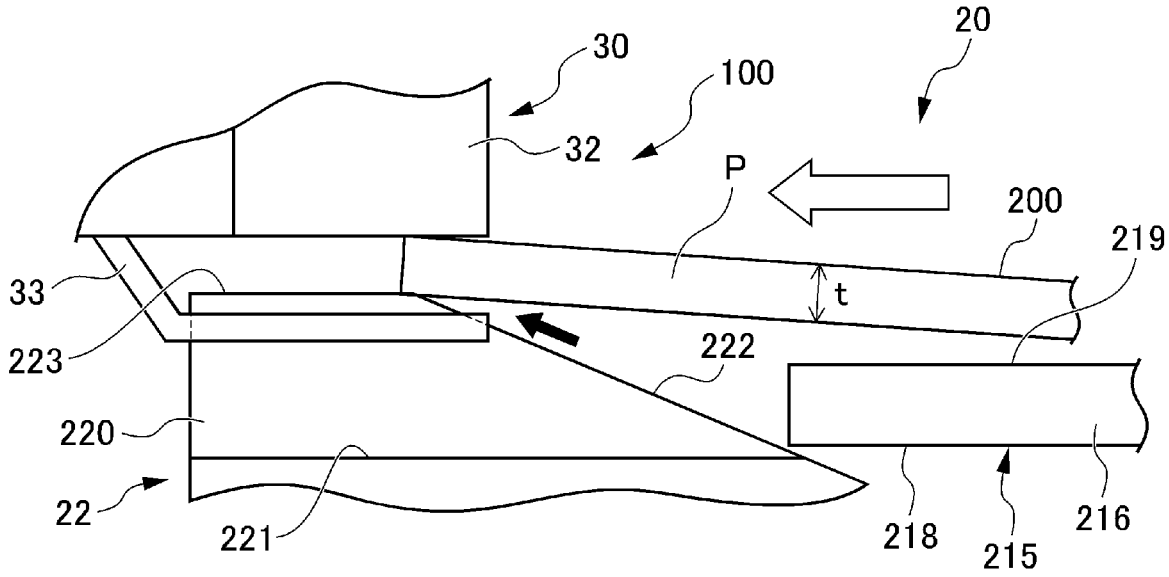
FIG. 5 is a diagram illustrating a state of a sheet position adjustment performed by the adjustment mechanism according to Embodiment 1.

FIG. 5 is a diagram illustrating a state of positional adjustment of the sheet P, performed by the adjustment mechanism 22 according to Embodiment 1.

The sheet P conveyed through the fixed guide 215 by the pair of rollers 210 is further conveyed to a far side between the claw base 32 and the claw 33, while being guided by the movable guide 220 that is located upper than the claw 33. The range in the vertical direction (the vertical range) where the sheet P enters between the claw base 32 and the claw 33 is narrowed according to a thickness t of the sheet P. Therefore, when the sheet P reaches the transfer position 100, the sheet P is guided to an appropriate position without the leading end of the sheet P flapping. In this state, the leading end of the sheet P is held (gripped) by the gripper 30.

As described above, the sheet conveying device 20 according to Embodiment 1 includes the roller conveyance unit 21 (that functions as a sheet conveyor), the fixed guide 215 (that functions as a guide), the transfer cylinder 131 (that functions as a rotary conveyor), the gripper 30 (that functions as a gripper) mounted on the transfer cylinder 131, and the adjustment mechanism 22. The leading end of the sheet P enters the gripper 30 through a sheet entering range (i.e., the interval d1) of the gripper 30. The adjustment mechanism 22 adjusts the sheet entering range in a direction intersecting with the sheet surface 200. By so doing, the position of the leading end of the sheet P that enters the gripper 30 along with conveyance of the roller conveyance unit 21 is adjustable in the direction intersecting the sheet surface 200.

With this configuration, the range in which the sheet P enters the gripper 30 according to the thickness t of the sheet P is adjusted to the vertical direction (i.e., the direction intersecting the sheet surface 200). Therefore, the sheet P enters between the claw base 32 and the claw 33 at an appropriate position, thereby restraining flapping of the sheet P. The sheet P is gripped by the claw base 32 and the claw 33 while the position of the sheet P is maintained appropriately. Therefore, inconvenience that occurs when the sheet P is conveyed from the roller conveyance unit 21 to the gripper 30 is restrained effectively. In addition, the sheet entering range corresponds to the thickness t of the sheet P. Therefore, a timing at which the claw base 32 and the claw 33 grip the sheet P according to the thickness t of the sheet P becomes constant, and the claw base 32 and the claw 33 smoothly grip the sheet P.

Further, the adjustment mechanism 22 according to the present embodiment, Embodiment 1, includes the movable guide 220 that moves in the direction perpendicular to the sheet conveying surface 219. By moving the movable guide 220, the sheet entering range of the gripper 30 is adjusted, and therefore the position of the leading end of the sheet P is adjusted. With this configuration, the sheet entering range is accurately adjusted according to the thickness t of the sheet P by moving (lifting and lowering) the movable guide 220 in the vertical direction.

Further, the sheet conveying device 20 according to the present embodiment, Embodiment 1, includes the motor 36 (that functions as a drive device) that drives the adjustment mechanism 22 to adjust the position of entrance of the sheet P, and the controller 51 that controls the drive amount of the motor 36 based on the thickness information indicating the thickness t of the sheet P. According to this configuration, with easy operation, the appropriate sheet entering range between the claw base 32 and the claw 33 (i.e., the interval d1) is automatically set according to the thickness t of the sheet P.

It is to be noted that, in the above-described embodiment, Embodiment 1, the movable guide 220 moves in the vertical direction. However, the configuration of the movable guide 220 is not limited to the above-described configuration. For example, the movable guide 220 may move in a direction oblique to the vertical direction. Moreover, in the above-described embodiment, the fixed guide 215 and the movable guide 220 are separate members. However, the configuration of the sheet conveying device 20 is not limited to the above-described configuration. For example, the fixed guide 215 and the movable guide 220 may be composed integrally as a single unit. In other words, this disclosure is applicable to a configuration having an adjustment mechanism to perform positional adjustment of the leading end of the sheet P by lifting a lower guide portion (e.g., the lower guide portion 216).

Next, a description is given of another adjustment mechanism that has a configuration different from the adjustment mechanism 22 according to Embodiment 1.

It is to be noted that, in the following description, components that are the same as or similar to those in the above-described embodiment (Embodiment 1) may be denoted by the same reference numerals and the description thereof may be omitted.

Figure 6:
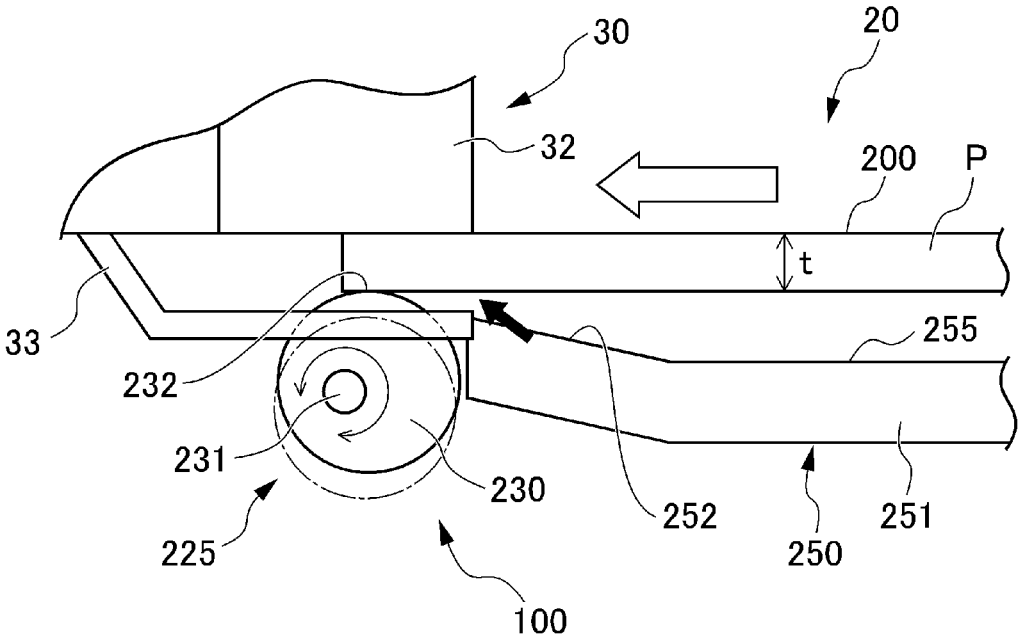
FIG. 6 is a diagram illustrating a state of a sheet position adjustment performed by an adjustment mechanism according to Embodiment 2.

FIG. 6 is a diagram illustrating a state of a positional adjustment of a sheet P performed by an adjustment mechanism 225 according to Embodiment 2.

The adjustment mechanism 225 functions as an adjuster. The adjustment mechanism 225 illustrated in FIG. 6 has a substantially round bar shape and is rotatably supported by a frame at a position facing the gripper 30 at the transfer position 100. A rotary adjusting member 230 includes a rotary shaft 231 that is an eccentric shaft. The rotary adjusting member 230 that functions as a rotary adjuster rotates about the rotary shaft 231. In Embodiment 2, a fixed guide 250 includes a lower guide portion 251 having a sheet conveying face 255. A sloped face 252 is disposed downstream from the sheet conveying face 255 in the sheet conveying direction. It is to be noted that the sheet conveying face 255 according to Embodiment 2 corresponds to a face of the lower guide portion 251 along the sheet conveyance direction, except the sloped face 252.

The rotary adjusting member 230 has a shape that does not interfere with the claw 33. In Embodiment 2, grooves are formed on the circumferential surface of the rotary adjusting member 230, in order to avoid interference with the claw 33. The depth of each of the grooves is set (determined) based on the trajectory of the rotary adjusting member 230. Accordingly, a contact portion 232 of the rotary adjusting member 230 is movable to a position to narrow the sheet entering range between the claw base 32 and the claw 33.

Since the rotary shaft 231 of the rotary adjusting member 230 is eccentric, the height of the contact portion 232 of the rotary adjusting member 230 with respect to the sheet P (in other words, a position in a direction perpendicular to the sheet conveying surface 219) varies depending on the rotational angle (in other words, a phase). In Embodiment 2, the rotational angle of the rotary adjusting member 230 is adjusted according to the thickness t of the sheet P, so as to set the sheet entering range between the claw base 32 and the claw 33.

The rotary adjusting member 230 that stands by at a position indicated by a broken line is mechanically connected to a motor that functions as a drive device, and therefore rotates and moves to a position indicated by a solid line along with rotation of the motor. Similar to Embodiment 1, the rotary adjusting member 230 according to Embodiment 2 automatically moves to adjust the entrance position of the sheet P. In order to restrain the position of the rotary adjusting member 230 at the rotational angle set according to the thickness t of the sheet P, the controller 51 adjusts the drive amount of the motor.

Figure 7:
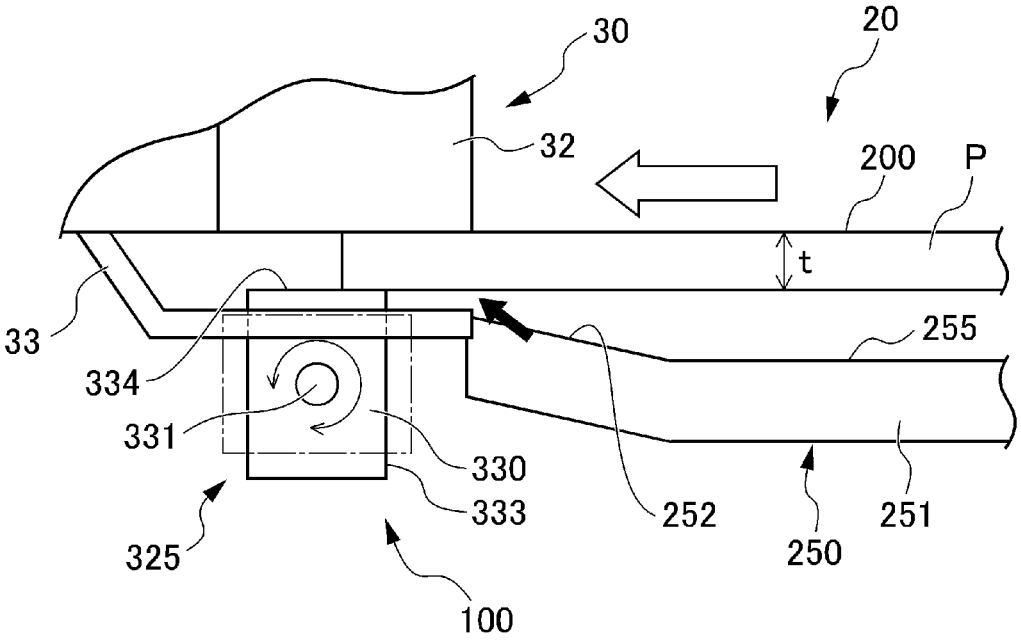
FIG. 7 is a diagram illustrating a state of a sheet position adjustment performed by an adjustment mechanism according to Embodiment 3.

FIG. 7 is a diagram illustrating a state of a positional adjustment of a sheet P performed by an adjustment mechanism 325 according to Embodiment 3.

In Embodiment 3, a rotary adjusting member 330 having a configuration different from the rotary adjusting member 230 according to Embodiment 2 is provided to set the sheet entering range between the claw base 32 and the claw 33. It is to be noted that the lower guide portion 251 of the fixed guide 250 according to Embodiment 3 has the configuration identical to the lower guide portion 251 according to Embodiment 2.

The adjustment mechanism 325 functions as an adjuster and the rotary adjusting member 330 functions as a rotary adjuster. The rotary adjusting member 330 illustrated in FIG. 7 has a square bar shape and is rotatably supported by a frame at a position facing the gripper 30 at the transfer position 100. Similar to Embodiment 2, grooves are formed in the rotary adjusting member 330 according to Embodiment 3, in order to avoid interference with the claw 33. It is to be noted that a rotary shaft 331 of the rotary adjusting member 330 may be eccentric or non-eccentric, that is, may be located at the center.

In Embodiment 3, the rotary adjusting member 330 has a rectangular shape in cross section perpendicular to the axial direction, and the height of a contact portion of the sheet P (in other words, a position in a direction perpendicular to the sheet conveying surface 219) varies depending on the rotational angle (in other words, the phase).

In FIG. 7, the rotary adjusting member 330 has a long side portion 333 and a short side portion 334. The long side portion 333 of the rotary adjusting member 330 extends in the horizontal direction when the rotary adjusting member 330 is located at a position indicated by a broken line in FIG. 7. The short side portion 334 of the rotary adjusting member 330 extends in the horizontal direction when the rotary adjusting member 330 is located at a position indicated by a solid line in FIG. 7. When narrowing the sheet entering range between the claw base 32 and the claw 33 according to the thickness t of the sheet P, the rotary adjusting member 330 is rotated in a direction from the position indicated by the broken line to the position indicated by the solid line. Similar to the rotary shaft 231 according to Embodiment 2, the rotary shaft 331 according to Embodiment 3 is mechanically connected to a motor that functions as a drive device, and the controller 51 controls the rotational angle of the motor.

It is to be noted that the rotational angle of the rotary adjusting member 330 is not limited to an angle in units of 90 degrees. In Embodiment 3, for example, the sheet entering range between the claw base 32 and the claw 33 may be adjusted with the square portion of the rotary adjusting member 330. Moreover, the shape of the rotary adjusting member 330 is not limited to a square bar shape but may be a polygonal shape such as a triangle and a pentagon.

In Embodiment 2, the adjustment mechanism 225 includes the rotary adjusting member 230 that changes the position in the direction perpendicular to the sheet conveying surface 219 depending on the rotational angle. In Embodiment 3, the adjustment mechanism 325 includes the rotary adjusting member 330 that changes the position in the direction perpendicular to the sheet conveying surface 219 depending on the rotational angle. The adjustment mechanism 225 changes the rotational angle of the rotary adjusting member 230 to adjust the sheet entering range between the claw base 32 and the claw 33, thereby adjusting the position of the leading end of the sheet P. Similarly, the adjustment mechanism 325 changes the rotational angle of the rotary adjusting member 330 to adjust the sheet entering range between the claw base 32 and the claw 33, thereby adjusting the position of the leading end of the sheet P. As described above, the sheet entering range between the claw base 32 and the claw 33 is adjusted by rotating the rotary adjusting member 230 or the rotary adjusting member 330. Accordingly, the simple configuration of Embodiment 2 and the simple configuration of Embodiment 3 achieve the same effect as the configuration of Embodiment 1.

Figure 8:
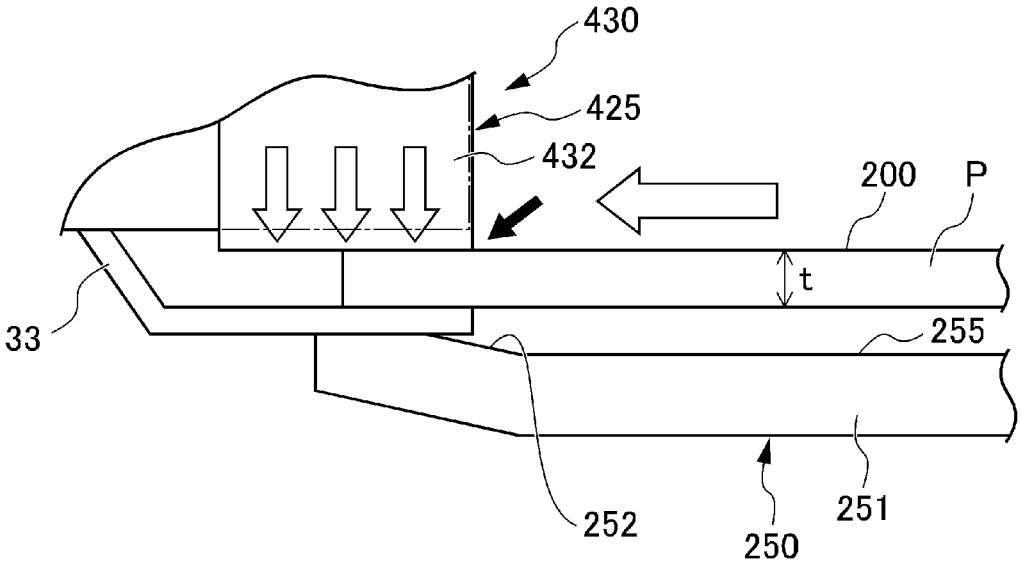
FIG. 8 is a diagram illustrating a state of a sheet position adjustment performed by an adjustment mechanism according to Embodiment 4.

FIG. 8 is a diagram illustrating a state of a positional adjustment of a sheet P performed by an adjustment mechanism 425 according to Embodiment 4.

The adjustment mechanism 425 functions as an adjuster. The adjustment mechanism 425 according to Embodiment 4 illustrated in FIG. 8 is basically identical to the adjustment mechanisms 22, 225, and 325, except that the adjustment mechanism 425 according to Embodiment 4 includes a gripper 430. It is to be noted that the lower guide portion 251 of the fixed guide 250 according to Embodiment 4 has the configuration identical to the lower guide portion 251 according to Embodiment 2.

In Embodiment 4, the gripper 430 is mounted on the transfer cylinder 131 and includes a claw base 432 and the claw 33. The claw base 432 is movable in a direction perpendicular to the sheet conveying surface 219. The claw 33 is disposed facing the claw base 432 to open and close relative to the claw base 432. The adjustment mechanism 425 moves the claw base 432 to adjust the sheet entering range between the claw base 432 and the claw 33, thereby adjusting the position of the leading end of the sheet P.

The claw base 432 is moved by a drive device such as a motor and an actuator. The amount of movement of the claw base 432 is adjusted according to the thickness t of the sheet P based on a control signal from the controller 51. Similar to Embodiments 1, 2, and 3, in Embodiment 4, the claw base 432 moves to adjust the sheet entering range between the claw base 432 and the claw 33. Therefore, the configuration of Embodiment 4 achieves the same effect as the configurations of Embodiments 1, 2, and 3.

The configurations according to the present embodiments of this disclosure are set forth as described above. However, this disclosure is not limited thereto and various modifications and alternations of this disclosure will be apparent to those skilled in the art appropriately.

In Embodiments 1 to 4, the controller 51 controls the adjustment mechanisms 22, 225, 325, and 425, based on the thickness information set in the operation device 53 but the configuration is not limited to the above-described configuration. For example, a detection unit that detects the thickness of the sheet P may be disposed in the image forming apparatus 1, so as to automatically perform the positional adjustment based on a detection signal of the detection unit. In this configuration, the adjusting position of the adjustment mechanism is changed at a timing at which the type of the sheet P changes.

In each of Embodiments 1 to 4, the sheet entering range between the claw base 32 (or the claw base 432) and the claw 33 is electrically adjusted based on a control signal of the controller 51. However, the configuration of each of the adjustment mechanisms 22, 225, 325, and 425 is not limited to the above-described configuration. For example, the operation electrically performed by the controller 51 may be omitted and the positional adjustment by an adjustment mechanism (i.e., the adjustment mechanisms 22, 225, 325, and 425) may be performed with an adjusting member such as an adjustment tool and a lever.

In the above-described embodiments, the ink jet type image forming apparatus in which the liquid discharge head 135 and the sheet P move relatively has been described as an example. However, the configuration of an image forming apparatus is not limited to the configuration to cause the liquid discharging heads 135 and the sheet P to move relatively. For example, this disclosure is applicable to sheet conveyance by a serial type image forming apparatus in which the liquid discharge head is movable and by a line type image forming apparatus in which the liquid discharge head is not movable.

Furthermore, the sheet conveying device is not limited to a device provided to an image forming apparatus but is applied to various devices or apparatuses that convey sheets. In addition, the sheet to be conveyed as a conveyance target is not limited to a specific material, and any sheet material, such as paper, thread, fiber, cloth, leather, metal, plastic, glass, wood, and ceramics, to which liquid can temporarily adhere may be used. For example, sheet materials used for film products, cloth products, such as clothing products, building materials, such as a wall sheet or flooring materials, leather products, and the like may be used.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a sheet conveyor configured to convey a sheet;

a guide configured to guide the sheet conveyed by the sheet conveyor;

a rotary conveyor disposed downstream from the guide in a sheet conveyance direction;

a gripper mounted on the rotary conveyor, the gripper configured to grip a leading end of the sheet;

an adjuster configured to adjust a sheet entering range of the gripper to which the leading end of the sheet enters, along with conveyance of the sheet conveyor, in a direction intersecting a sheet surface, wherein the sheet entering range comprises an interval between a horizontal face of the guide and a claw base of the gripper, and the sheet entering range is smaller than an interval between the claw base and a claw of the gripper;

a drive device configured to drive the adjuster to adjust the sheet entering range; and circuitry configured to determine a drive amount of the drive device based on thickness information of the sheet.

2. An image forming apparatus comprising:

the sheet conveying device according to claim 1; and an image forming device configured to form an image on the sheet conveyed by the sheet conveying device.

3. The sheet conveying device according to claim 1, wherein the adjuster includes a movable guide configured to move in a direction perpendicular to a sheet conveying face formed by the guide, and wherein the adjuster is configured to move the movable guide to adjust the sheet entering range.

4. The sheet conveying device according to claim 1, wherein the adjuster includes a rotary adjuster configured to change a position of the rotary adjuster in the direction perpendicular to a sheet conveying face formed by the guide, depending on a rotational angle of the rotary adjuster, and wherein the adjuster is configured to change the rotational angle of the rotary adjuster to adjust the sheet entering range.

5. The sheet conveying device according to claim 1, wherein the claw base is disposed on a side of the rotary conveyor and movable in a direction perpendicular to a sheet conveying face formed by the guide; and the claw is disposed facing the claw base to open and close relative to the claw base, and wherein the adjuster is configured to move the claw base to adjust the sheet entering range.

* * * * *